United States Patent [19]

Mangan

[11] 4,141,400

[45] Feb. 27, 1979

[54] PROTECTIVE HOLDER FOR MAGNETIC CARDS

[76] Inventor: James H. Mangan, 4601 19th Rd., North, Arlington, Va. 22207

[21] Appl. No.: 907,493

[22] Filed: May 19, 1978

[51] Int. Cl.[2] ..... A45C 11/18

[52] U.S. Cl. ..... 150/39; 206/39.6

[58] Field of Search ..... 206/39, 39.5, 39.6; 150/39

[56] References Cited

U.S. PATENT DOCUMENTS

| | | | |
|---|---|---|---|
| 489,125 | 1/1893 | Knight | 150/39 |
| 1,059,187 | 4/1913 | McKee | 206/39.6 |
| 1,670,343 | 5/1928 | Clemens | 150/39 |

*Primary Examiner*—Donald F. Norton

*Attorney, Agent, or Firm*—Bacon & Thomas

[57] ABSTRACT

A pair of plates are releasably held together to define a thin pocket for cards having a magnetic strip on one face. One of the plates has ribs between which the magnetic strip slides to protect that strip from abrasion and edge ribs in the pocket prevent the card from bending, curling or folding.

5 Claims, 3 Drawing Figures

PROTECTIVE HOLDER FOR MAGNETIC CARDS

BACKGROUND OF THE INVENTION

The use of cards having magnetized strips thereon is becoming a widespread practice. Many institutions, such as banks or the like, employ such cards for computerized accounting and many rapid transit systems use such cards as fare cards.

It has been found that such cards can become easily bent, folded or otherwise damaged to the extent that they are no longer accepted by the machines for which they were intended. Furthermore, the magnetic strips being placed on the surface of the card are subject to damage by abrasion or contact with metallic objects or magnetized materials.

The provision of cases for carrying credit cards and the like is well known. See, for example, the patent to Knight U.S. Pat. No. 489,125 or Cooksey U.S. Pat. No. 3,421,658. Such previous card holders, however, made no particular provision for protecting cards bearing magnetic strips and such cards placed in those folders would still be subject to damage by abrasion.

SUMMARY OF THE INVENTION

Stated briefly, the present invention comprises a card holder of substantially rigid material having a thin open ended pocket for reception of the card, one wall of the pocket being provided with ribs or the like between which the magnetic strip of the card can rest and thus be maintained out of contact with other objects.

It is, therefore, a principal object of this invention to provide a protective holder for a magnetic card capable of protecting the card against inadvertent folding or other damage while rendering the same readily accessible for use.

DESCRIPTION OF THE PREFERRED EMBODIMENT

Figure 3:
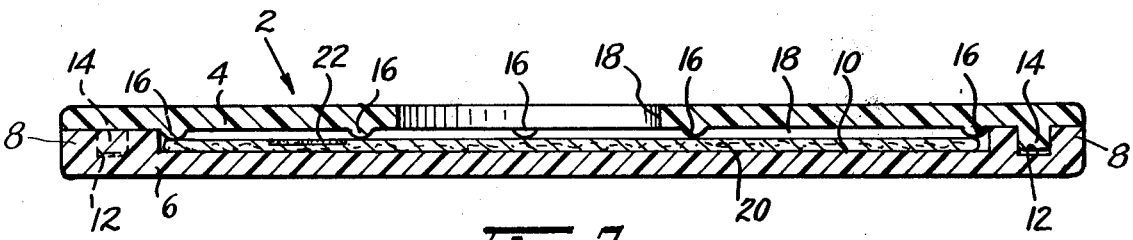
FIG. 3 is a transverse sectional view, on an enlarged scale, along the line 3—3 of FIG. 2.

In the drawings, numeral 2 indicates generally the protective card holder of the present invention and, as best seen in FIG. 3, the holder may be made of two plate like members 4 and 6 which may be molded of substantially rigid non-magnetic plastic material. The lower plate 6 is provided with a peripheral rim 8 extending around three sides thereof and defining a central recess 10. The rim 8 is shown as being provided with a plurality of sockets or openings 12 distributed around the periphery of the plate member.

Figure 1:
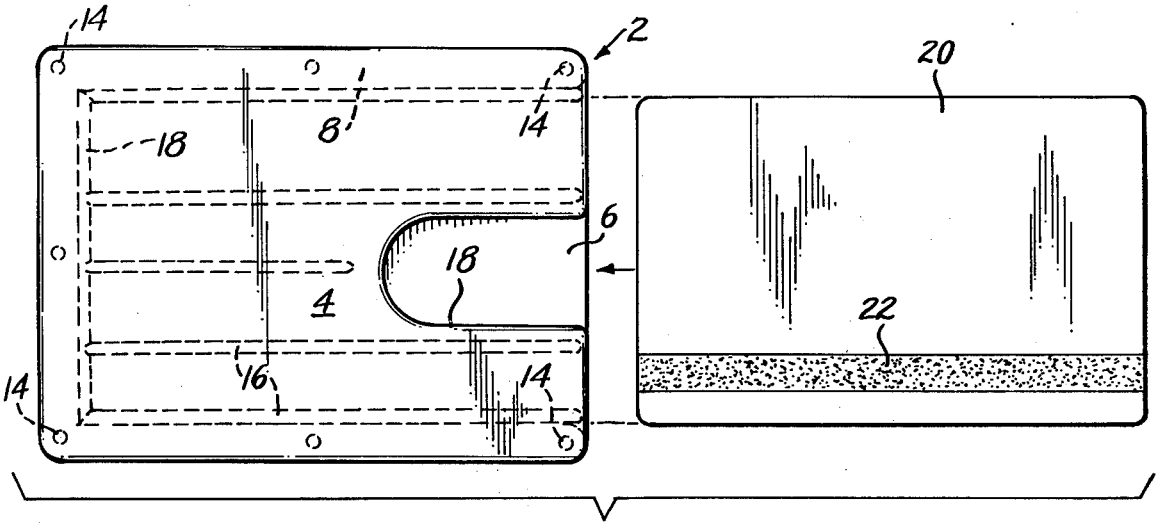
FIG. 1 is a plan view of the card holder of the present invention and showing a typical magnetic card in position to be inserted therein.
Figure 2:
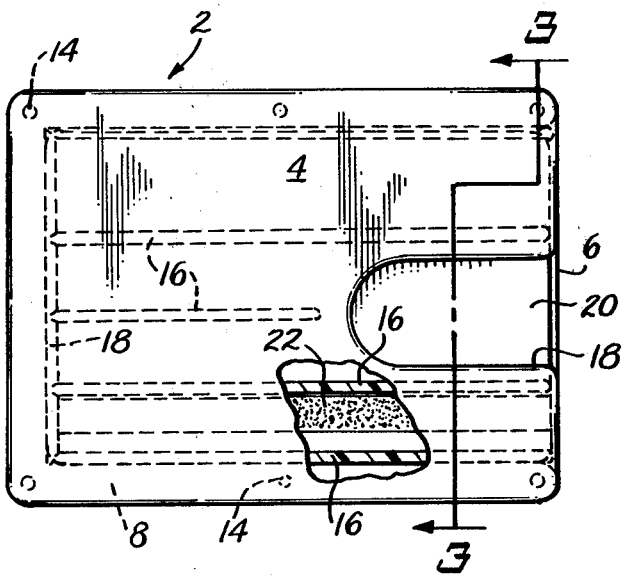
FIG. 2 is a view similar to FIG. 1 of the card holder itself with a portion broken away to show internal construction.

The upper plate 4 is of generally planar form but is provided with integral cylindrical pins 14 in position to enter and be frictionally held in the sockets 12. In addition, the plate 4 has integrally molded on its inner surface a number of spaced parallel ribs 16. Also, a transverse rib 18 is formed on the plate 4 to extend across the bottom of the recess 10 adjacent the transverse rim 8 on plate 6. As best shown in FIGS. 1 and 2, upper plate 4 is also provided with a cutout 18 whereby to render a card in the holder readily accessible to the user. In FIG. 1, numeral 20 represents a magnetic card for which the described holder is provided. As stated previously, such cards are in common use and include a strip 22 of magnetizable material extending along one surface and on which information may be recorded in magnetized code for various purposes, such as identifying accounts at a bank or for use in fare collecting and recording machines in common use in public transportation installations. Such magnetic strips are conventionally places at a more or less standard location on the card 20, spaced inwardly and generally parallel to one longitudinal edge of the card. The longitudinal ribs 16, previously described, are so spaced and positioned on the plate 4 that when a card 20 is inserted in the recess or pocket 10, the magnetized strip 22 (FIG. 2) assumes a position between a pair of ribs 16 as also indicated in FIG. 3. The ribs 16 extend toward but short of the lower plate 6 to leave sufficient room between those ribs and that plate for free sliding movement of the card 20, but sufficiently far to retain the card against excessive lateral movement and thus the ribs prevent the card from curling whereas the magnetized strip 22 is held out of contact or sliding engagement with any surface of the holder. The transverse rib 18 also bears against the inner end of the card to further prevent curling and to assist in frictionally retaining the card in the holder.

The cutout 18 permits the user to frictionally engage one surface of a card in the holder and readily withdraw the same for use.

In the form illustrated, the plates 4 and 6 are separable by frictionally withdrawing the pins 14 from the sockets 12. This permits cleaning of the pockets in the holder in the event debris or foreign material gets wedged therein. However, if desired, the plates 4 and 6 could be permanently cemented together. It is also to be noted that the pocket is thick enough for only a single card and the walls 4 and 6 prevent contact between the magnetic strip 22 of a card therein with any other magnetic card or material that could alter or damage the magnetically coded information on the strip.

While a single specific embodiment of the invention has been shown and described herein, the same is merely illustrative of the principles of the invention which is limited only by the scope of the appended claims.

I claim:

1. A protective holder for magnetic cards comprising:

a substantially rigid body defining a thin pocket opening through one end edge thereof, one of the side walls of said pocket having at least one pair of spaced parallel ribs extending inwardly from said one end edge said ribs being of a height less than the thickness of said pocket whereby a card having a magnetized strip on one face thereof may be inserted in said pocket with said strip extending between said ribs and out of contact with said one wall.

2. A holder as defined in claim 1 wherein said one side wall is provided with at least two pairs of said ribs defining a pair of parallel channels respectively adjacent opposite side edges of said pocket.

3. A holder as defined in claim 1 wherein said body comprises a pair of plate-like members and means releasably holding said members together to define opposite walls of said pocket.

4. A holder as defined in claim 3 wherein one of said members is provided with a U-shaped notch at said one edge to provide access to a face of a card in said pocket.

5. A holder as defined in claim 1 wherein said one side wall is provided with rib means extending along and closely adjacent the side edges and bottom edge of said pocket to hold the edges of a card therein against the other side wall and thereby prevent curling of the card.

* * * * *